US009850901B2

(12) United States Patent
Ignatiev et al.

(10) Patent No.: US 9,850,901 B2
(45) Date of Patent: Dec. 26, 2017

(54) COMPRESSOR SHELL ASSEMBLY

(71) Applicant: Emerson Climate Technologies, Inc., Sidney, OH (US)

(72) Inventors: Kirill M. Ignatiev, Sidney, OH (US); John Sheridan, Tipp City, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 41 days.

(21) Appl. No.: 14/875,100

(22) Filed: Oct. 5, 2015

(65) Prior Publication Data

US 2016/0115958 A1 Apr. 28, 2016

Related U.S. Application Data

(60) Provisional application No. 62/069,595, filed on Oct. 28, 2014.

(51) Int. Cl.
*F04B 17/00* (2006.01)
*F04C 18/02* (2006.01)
(Continued)

(52) U.S. Cl.
CPC ..... *F04C 18/0215* (2013.01); *F01C 21/10* (2013.01); *F04B 39/121* (2013.01);
(Continued)

(58) Field of Classification Search
CPC .. F04C 2240/10; F04C 23/008; F04C 27/008; F01C 21/10; F04B 39/121
USPC ..... 418/1, 48, 201.1, 152–153, 182
See application file for complete search history.

(56) References Cited

U.S. PATENT DOCUMENTS 4,684,837 A 8/1987 Schaefer et al.
5,431,547 A * 7/1995 Boyko ..... F04D 7/02 417/366
(Continued)

FOREIGN PATENT DOCUMENTS

CN 1328215 A 12/2001
CN 1666021 A 9/2005
(Continued)

OTHER PUBLICATIONS

Office Action regarding Chinese Patent Application No. 201510700688.9, dated May 3, 2017. Translation provided by Unitalen Attorneys at Law.
(Continued)

*Primary Examiner* — Mark Laurenzi
*Assistant Examiner* — Anthony Ayala Delgado
(74) *Attorney, Agent, or Firm* — Harness, Dickey & Pierce, P.L.C.

(57) ABSTRACT

A compressor may include a compression mechanism and a shell assembly. The shell assembly may include first and second snap rings, a body, and first and second caps cooperating with the body to enclose the compression mechanism therein. The body may include first and second ends and an inner surface extending between both ends. The first cap may be received within the first end and may include a first side wall having a first groove. The second cap may be received within the second end and may include a second side wall having a second groove. The first snap ring may be disposed within the first groove and may engage the first end to restrict removal of the first cap from the body. The second snap ring may be disposed within the second groove and may engage the second end to restrict removal of the second cap from the body.

20 Claims, 4 Drawing Sheets

(51) Int. Cl.

| | |
|---|---|
| ***F04D 29/62*** | (2006.01) |
| ***F04D 29/64*** | (2006.01) |
| ***F04B 39/12*** | (2006.01) |
| ***F01C 21/10*** | (2006.01) |
| ***F04C 23/00*** | (2006.01) |
| ***F04C 27/00*** | (2006.01) |
| *F04D 29/40* | (2006.01) |

(52) U.S. Cl.
CPC ..... *F04C 23/008* (2013.01); *F04C 27/008* (2013.01); *F04D 29/624* (2013.01); *F04D 29/644* (2013.01); *F04D 29/403* (2013.01); *F05D 2260/30* (2013.01)

(56) References Cited

U.S. PATENT DOCUMENTS 5,456,161 A * 10/1995 Yuda ..... F15B 15/1442 277/643
6,857,863 B1 2/2005 Modrzejewski et al.
7,836,817 B2 * 11/2010 Tokumoto ..... F15B 15/1419 92/169.1
2003/0194331 A1 10/2003 Pitla et al.

FOREIGN PATENT DOCUMENTS

| | | | |
|---|---|---|---|
| CN | 101220822 | A | 7/2008 |
| CN | 101349260 | A | 1/2009 |
| CN | 102720672 | A | 10/2012 |
| CN | 103375394 | A | 10/2013 |
| CN | 205388005 | U | 7/2016 |
| CN | 205401051 | U | 7/2016 |
| JP | 2010090789 | A | 4/2010 |

OTHER PUBLICATIONS

Office Action regarding Chinese Patent Application No. 201510708105.7, dated Jun. 1, 2017. Translation provided by Unitalen Attorneys at Law.

* cited by examiner

COMPRESSOR SHELL ASSEMBLY

CROSS-REFERENCE TO RELATED APPLICATIONS

This application claims the benefit of U.S. Provisional Application No. 62/069,595, filed on Oct. 28, 2014. The entire disclosure of the above application is incorporated herein by reference.

FIELD

The present disclosure relates to a compressor, and more particularly, to a compressor shell assembly.

BACKGROUND

This section provides background information related to the present disclosure and is not necessarily prior art.

To provide a heating and/or cooling effect, a compressor may be used in a refrigeration, heat pump, HVAC, or chiller system (generically, "climate control system") to circulate a working fluid therethrough. The compressor may be one of a variety of compressor types. For example, the compressor may be a scroll compressor, a rotary-vane compressor, a reciprocating compressor, a centrifugal compressor, or an axial compressor. Regardless of the exact type of compressor employed, consistent and reliable construction and assembly of the compressor shell assembly is desired to ensure that the compressor can effectively circulate the working fluid through the climate control system.

SUMMARY

This section provides a general summary of the disclosure, and is not a comprehensive disclosure of its full scope or all of its features.

In one form, the present disclosure provides a compressor that may include a compression mechanism and a shell assembly housing the compression mechanism therein. The shell assembly may include a body, an end cap, and a snap ring. The end cap may be at least partially received into the body. The snap ring may engage the body and restrict removal of the end cap from the body.

In some configurations, the body may include an inner surface disposed between a first and second end of the body. The inner surface may have an annular groove disposed near the first end for receiving the snap ring therein.

In some configurations, the snap ring may be resiliently movable between an uncompressed condition in which the snap ring has a first diameter and a compressed condition in which the snap ring has a second diameter that is smaller than the first diameter.

In some configurations, the inner surface of the body may include a ledge disposed near the first end. The end cap may include a radially outwardly extending flange engaging the ledge. The ledge may restrict movement of the end cap relative to the body in a first axial direction. The snap ring may restrict movement of the end cap relative to the body in a second opposite axial direction.

In some configurations, the flange may include a groove receiving an O-ring therein.

In some configurations, the body may include a chamfered edge disposed at the first end facilitating compression of the snap ring.

In some configurations, the end cap may include an outer wall having a discharge fitting extending therethrough.

In some configurations, the body may include at least one releasing orifice disposed near the first end providing access to the annular groove to release the snap ring received therein.

In some configurations, the end cap may include an annular side surface having a first groove partially receiving the snap ring therein and a second groove receiving an O-ring seal therein.

In some configurations, the end cap may include a shoulder extending radially outward beyond an inner surface of the body and engaging the first end of the body.

In another form, the present disclosure provides a compressor that may include a compression mechanism and a shell assembly. The shell assembly may include first and second snap rings, a body, and first and second end caps cooperating to enclose the compression mechanism within the body. The body may include first and second open ends and an inner surface extending between the first and second ends. The inner surface may include a first groove located near the first end and a second groove located near the second end. The first end cap may be at least partially received within the first end and may include a first outwardly extending flange engaging the body. The second end cap may be at least partially received within the second end and may include a second outwardly extending flange engaging the body. The first snap ring may be disposed within the inner surface of the body and may engage the first groove and the first end cap to restrict removal of the first end cap from the body. The second snap ring may be disposed within the inner surface of the body and may engage the second groove and the second end cap to restrict removal of the second end cap from the body.

In some configurations, the first outwardly extending flange may engage a first ledge disposed on the inner surface of the body near the first end, and the second outwardly extending flange may engage a second ledge disposed on the inner surface of the body near the second end.

In some configurations, both of the first and second outwardly extending flanges may include an annular groove receiving an O-ring seal therein.

In some configurations, the first outwardly extending flange may engage the first end of the body, and the second outwardly extending flange may engage the second end of the body.

In some configurations, the body may include a first chamfered edge disposed at the first end facilitating compression of the snap ring, and a second chamfered edge disposed at the second end facilitating compression of the second snap ring.

In some configurations, the body may include at least one orifice extending into each of the first and second grooves facilitating removal of the first and second snap rings from the first and second grooves, respectively.

In some configurations, both of the first and second end caps may include an annular side wall having an annular channel, the first snap ring may engage the annular channel of the first end cap, and the second snap ring may engage the annular channel of the second end cap.

In some configurations, both of the annular side walls may include a second annular channel each receiving an O-ring seal therein.

In some configurations, the first end cap may include an outer wall having a discharge fitting extending therethrough, and the second end cap may include an outer wall having a mounting base.

In some configurations, the snap ring may be resiliently movable between an uncompressed condition in which the snap ring has a first diameter and a compressed condition in which the snap ring has a second diameter that is smaller than the first diameter.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
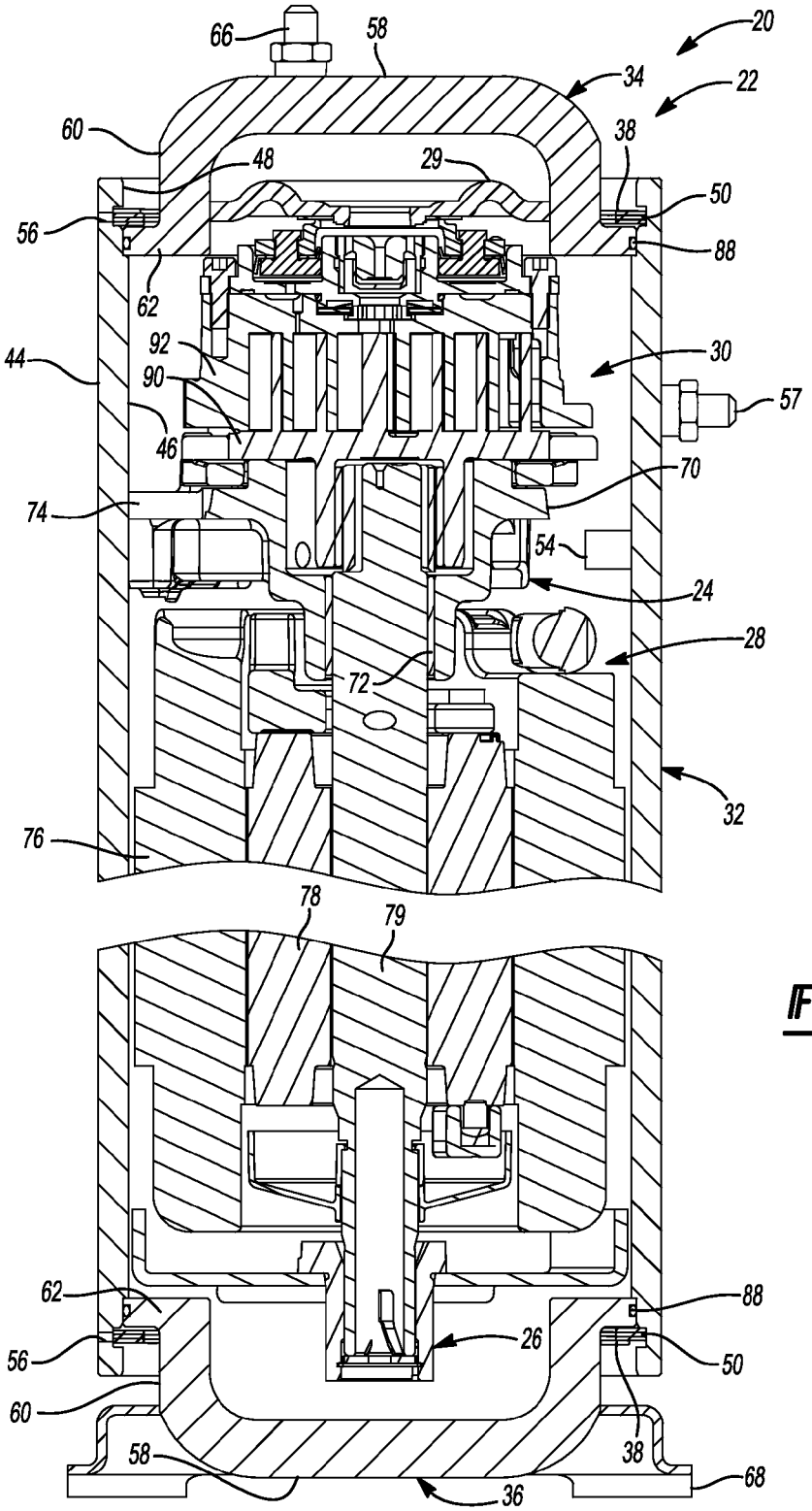
FIG. 1 is a cross-sectional view of a compressor including a compressor shell assembly according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a compressor 20 is provided that may include a compressor shell assembly 22, first and second bearing-housing assemblies 24, 26, a motor assembly 28, and a compression mechanism 30.

The compressor shell assembly 22 may form a compressor housing and may contain therein the first and second bearing-housing assemblies 24, 26, the motor assembly 28, and the compression mechanism 30. The compressor shell assembly 22 may include a body 32, a first end cap 34, a second end cap 36, and a pair of snap rings 38.

Figure 2:
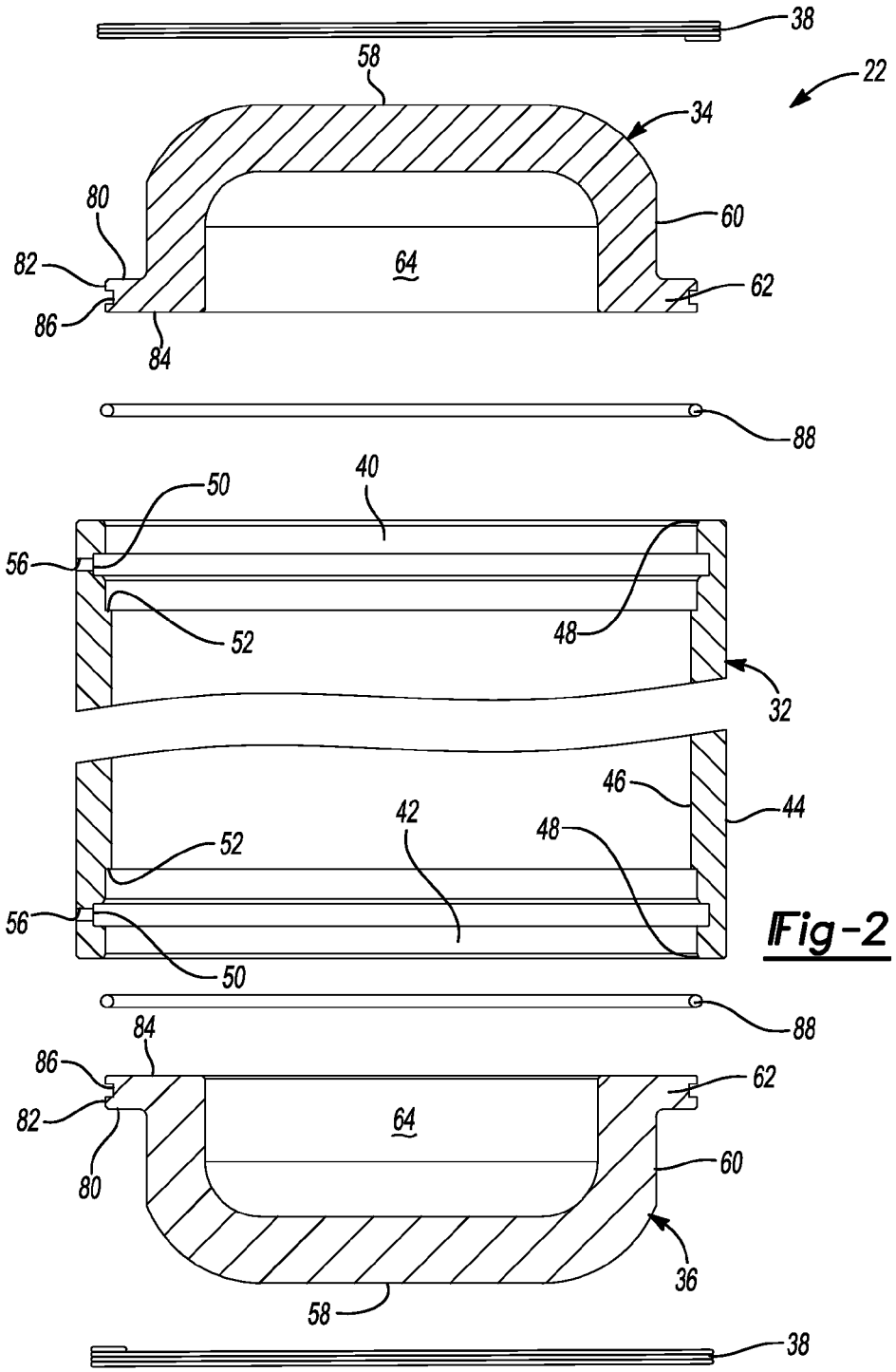
FIG. 2 is an exploded cross-sectional view of the compressor shell assembly of FIG. 1.

Referring now to FIGS. 1 and 2, the body 32 may be an annular member, and may include a first end 40, a second end 42, and outer and inner surfaces 44, 46 extending longitudinally between the first and second ends 40, 42.

The inner surface 46 of the body 32 may include a pair of chamfered edges 48, a pair of locking grooves 50, and a pair of ledges 52. Each chamfered edge 48 may be an angled surface (e.g. 45 degrees) formed between the inner surface 46 and a respective one of the ends 40, 42 of the body 32. Each locking groove 50 may be an annular recess formed in the inner surface 46 of the body 32 and may be located near a respective one of the chamfered edges 48. Each ledge 52 may be an annular surface located near a respective one of the locking grooves 50.

The inner surface 46 of the body 32 may also include features 54 (shown schematically in FIG. 1) that may be used for locating, aligning, and/or attaching various compressor components to the body 32. For example, the features 54 may include detents and/or protrusions for engaging the bearing-housing assemblies 24, 26, the motor assembly 28, and/or a partition plate 29 that separates a suction-pressure region from a discharge-pressure region of the compressor 20.

Disposed through the outer and inner surfaces 44, 46, the body 32 may include an inlet fitting 57 and one or more releasing orifices 56 extending into each of the locking grooves 50. The inlet fitting 57 may receive working fluid from a low side of a climate control system (not shown) into which the compressor 20 may be installed, and communicate the working fluid to the compression mechanism 30, described further below.

The first and the second end caps 34, 36 may each include a first wall 58 closing an end of an annular side wall 60 having an annular flange 62 extending radially outward therefrom. An open end 64, generally defined by the annular side wall 60, may be located opposite the first wall 58.

The first wall 58 of the first end cap 34 may include a discharge fitting 66 communicating working fluid discharged from the compression mechanism 30 to a high side of a climate control system into which the compressor 20 may be installed. In some configurations (e.g., configurations in which the compressor 20 is a high-side compressor), the first wall 58 or another portion of the first end cap 34 may include the inlet fitting 57. The first wall 58 of the second end cap 36 may include a base 68. The base 68 may be mounted to the first wall 58 or may be integrally formed therewith.

With reference to FIG. 2, the annular flange 62 may include an axially outward-facing wall 80, a side wall 82, and an axially inward-facing wall 84. The side wall 82 may include an annular groove 86 receiving therein an elastomeric gasket or O-ring 88 seal.

The snap rings 38 may be resiliently compressible members configured to be compressed radially inward. In other words, when uncompressed, the snap rings 38 may have a first diameter, and when compressed, the snap rings 38 may have a second diameter that is smaller than the first diameter. The snap rings 38 may fit around the annular side wall 60 of the end caps 34, 36, and once compressed, each snap ring 38 may engage a respective one of the locking grooves 50 formed in the inner surface 46 of the body 32. The snap rings 38 may be, for example, SPIRLOX retaining rings produced by the SMALLEY STEEL RING COMPANY.

The first bearing housing assembly 24 may be fixed relative to the body 32 and may include a main bearing-housing 70 and a main bearing 72. The main bearing-housing 70 may axially support the compression mechanism 30 and may house the main bearing 72 therein. The main bearing-housing 70 may include a plurality of radially extending arms 74 engaging the body 32.

The motor assembly 28 may include a motor stator 76, a rotor 78, and a drive shaft 79. The motor stator 76 may be press fit into the body 32 to fix the stator 76 relative to the body 32. The drive shaft 79 may be rotatably driven by the rotor 78, which may be press fit onto the drive shaft 79. The drive shaft 79 may be rotatably supported by the first and second bearing-housing assemblies 24, 26.

The compression mechanism 30 may include an orbiting scroll 90 and a non-orbiting scroll 92. The scrolls 90, 92 may meshingly engage one another to compress the working fluid circulating through the climate control system.

While the compressor 20 is described as being a scroll compressor, it will be appreciated that the compressor 20 may be any other type of compressor, such as a reciprocating compressor, a rotary-vane compressor, a centrifugal compressor, or an axial compressor, for example. Furthermore, while the compressor 20 shown in FIG. 1 is a low-side compressor (i.e., the motor assembly 28 and compression mechanism 30 are disposed in a suction-pressure region of the compressor 20), in some configurations, the compressor 20 could be a high-side compressor (e.g., wherein the motor assembly 28 and compression mechanism 30 are disposed in a discharge-pressure region of the compressor 20).

With continued reference to FIGS. 1 and 2, assembly of the compressor shell assembly 22 will be described. The O-ring seal 88 may be installed into a respective one of the annular grooves 86. The open end 64 of the end caps 34, 36 may be inserted into one of the corresponding ends 40, 42 of the body 32 until the inward-facing wall 84 of each annular flange 62 abuts a corresponding ledge 52. As the end caps 34, 36 are inserted into the body 32, the O-ring seals 88 may be compressed and form a seal therebetween.

Each of the snap rings 38 may be placed around the annular side wall 60 of a respective one of the end caps 34, 36 and inserted into the corresponding end 40, 42 of the body 32. As each snap ring 38 contacts the corresponding chamfered edge 48, each snap ring 38 may be compressed radially inward to fit within the inner surface 46 of the body 32. The snap rings 38 may be inserted into the body 32 until each snap ring 38 aligns with a corresponding one of the locking grooves 50. Once aligned, each snap ring 38 may be allowed to resiliently un-compress radially outward therein and restrict or prevent separation of the corresponding end cap 34, 36 and the body 32.

It should be understood that both end caps 34, 36 may be assembled onto the body 32 simultaneously, or the first end cap 34 may be assembled onto the body 32 before or after the second end cap 36 is assembled onto the body 32. Furthermore, the bearing-housing assemblies 24, 26, the motor assembly 28, the partition place 29, the compression mechanism 30, and/or any of the other components of the compressor 20 may be installed within the body 32 before one or both of the end caps 34, 36 are assembled onto the body 32.

Disassembly of the compressor shell assembly 22 may be accomplished by inserting a probe-like object (e.g., an elongated, rigid object) into the releasing orifices 56 to radially inwardly compress the snap rings 38 so that the snap rings 38 can be removed from the body 32. The end caps 34, 36 may then be separated from the corresponding ends 40, 42 of the body 32. It should be understood that although both end caps 34, 36 were described as being disassembled from the body 32 simultaneously, the first end cap 34 may be disassembled from the body 32 before or after the second end cap 36 is disassembled from the body 32.

Figure 3:
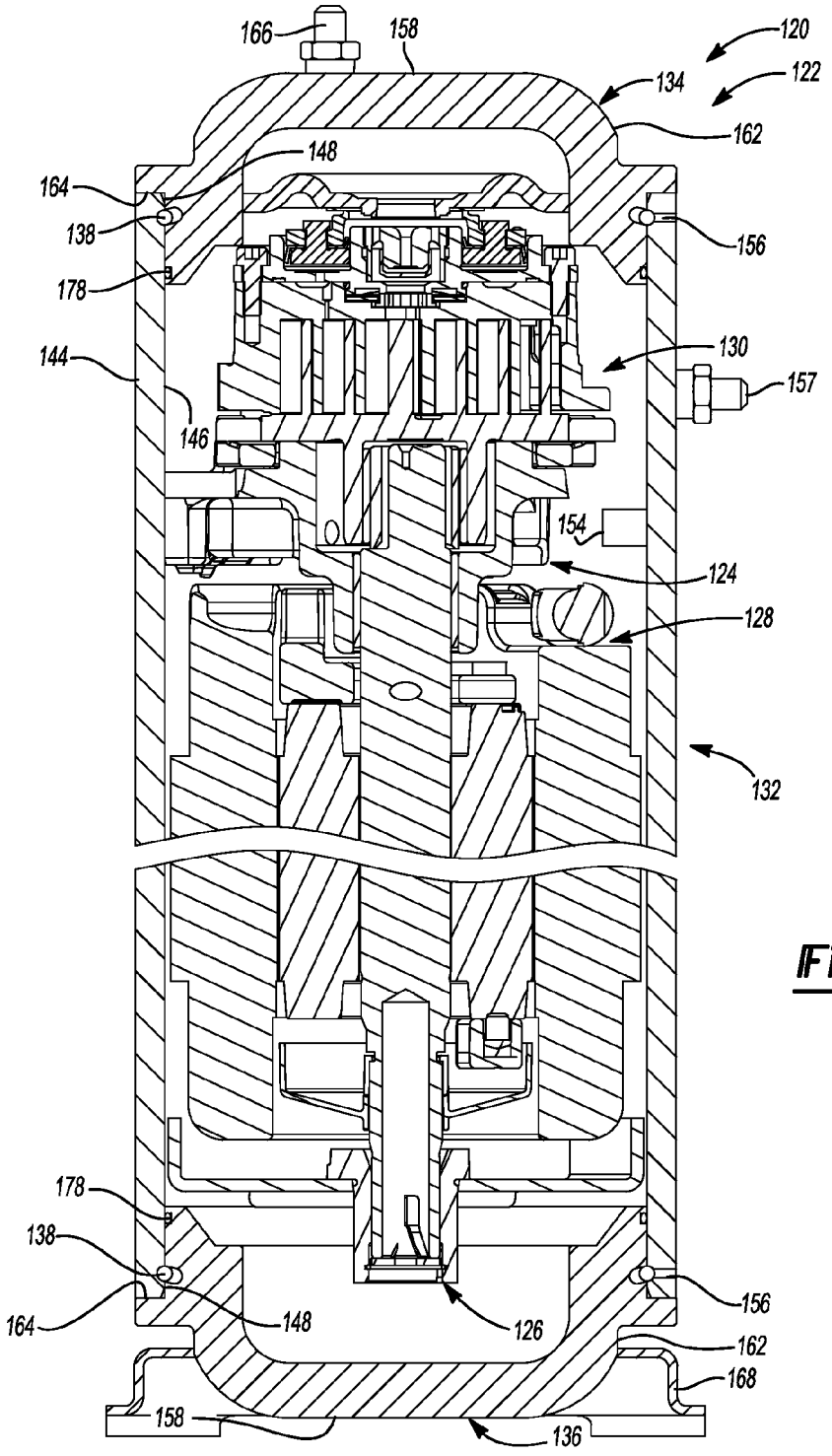
FIG. 3 is a cross-sectional view of another compressor including another compressor shell assembly according to the principles of the present disclosure.

With reference to FIG. 3, a compressor 120 is provided that may include a compressor shell assembly 122, first and second bearing-housing assemblies 124, 126, a motor assembly 128, and a compression mechanism 130. The structures and/or functions of the bearing-housing assemblies 124, 126, the motor assembly 128, and the compression mechanism 130 may be similar or identical to that of the bearing-housing assemblies 24, 26, the motor assembly 28, and the compression mechanism 30 described above, and therefore, will not be described again in detail. It will be appreciated, like the compressor 20 described above, the compressor 120 may be any type of compressor, such as a scroll compressor, a reciprocating compressor, a rotary-vane compressor, a centrifugal compressor, or an axial compressor, for example.

The compressor shell assembly 122 may form a compressor housing and may contain therein the first and second bearing-housing assemblies 124, 126, the motor assembly 128, and the compression mechanism 130. The compressor shell assembly 122 may include a body 132, a first end cap 134, a second end cap 136, and a pair of snap rings 138.

Figure 4:
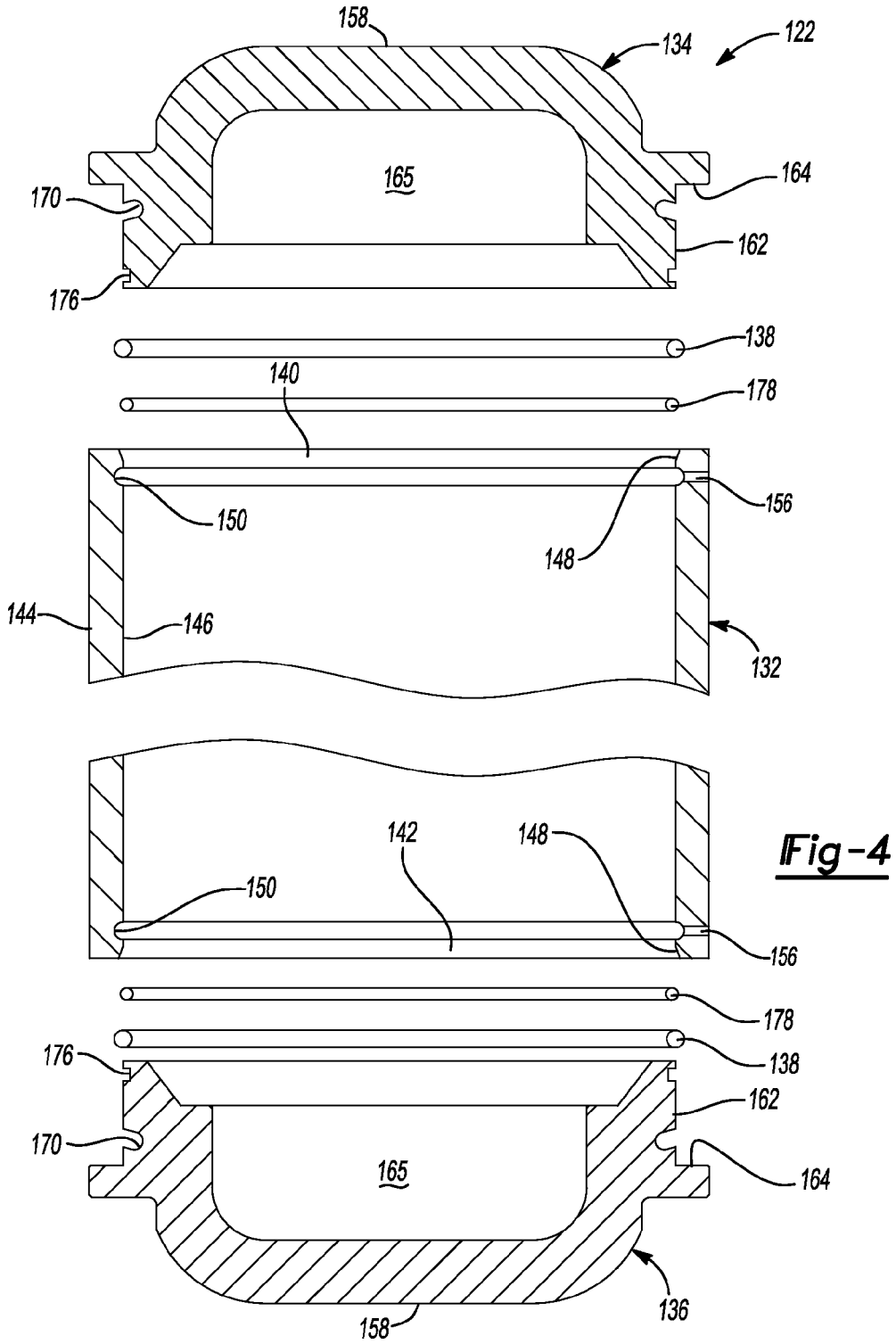
FIG. 4 is an exploded cross-sectional view of the compressor shell assembly of FIG. 3.

Referring now to FIGS. 3 and 4, the body may be an annular member and may include a first end 140, a second end 142, and outer and inner surfaces 144, 146 extending longitudinally between the first and second ends 140, 142.

The inner surface 146 of the body 132 may include a pair of chamfered edges 148 and a pair of locking grooves 150. Each chamfered edge 148 may be an angled surface (e.g. 45 degrees) formed between the inner surface 146 and a respective one of the ends 140, 142 of the body 132. Each locking groove 150 may be an annular recess formed in the inner surface 146 of the body 132 and may be located near a respective one of the chamfered edges 148.

The inner surface 146 of the body 132 may also include features 154 (shown schematically in FIG. 3) that may be similar or identical to features 54 described above, and therefore, will not be described again in detail.

The outer and inner surfaces 144, 146 of the body 132 may also include an inlet fitting 157 and one or more releasing orifices 156 extending into each of the locking grooves 150. The structure and/or function of the inlet fitting 157 may be similar or identical to the inlet fitting 57 described above, and therefore, will not be described again in detail.

The first and the second end caps 134, 136 may each include a first wall 158 closing an end of an annular side wall 162 having an annular shoulder 164 extending radially outward therefrom. An open end 165, generally defined by the annular side wall 162, may be located opposite the first wall 158.

The first wall 158 of the first end cap 134 may include a discharge fitting 166 and the first wall 158 of the second end cap 136 may include a base 168. The structures and/or functions of the discharge fitting 166 and the base 168 may be similar or identical to the discharge fitting 66 and the base 68 described above, respectively, and therefore will not be described again in detail.

With reference to FIG. 4, the annular side wall 162 of the end caps 134, 136 may include a first annular groove 170 receiving therein one of the snap rings 138, described below, and a second annular groove 176 receiving therein an elastomeric gasket or O-ring seal 178.

The snap rings 138 may be resiliently compressible members configured to be compressed radially inward. In other words, when uncompressed, the snap rings 138 may have a first diameter, and when compressed, the snap rings 138 may have a second diameter that is smaller than the first diameter. The snap rings 138 may fit around the annular side wall 162 of the end caps 134, 136, and when compressed, each snap ring 138 may engage a respective one of the locking grooves 150 formed in the inner surface 146 of the body 132.

With continued reference to FIGS. 3 and 4, assembly of the compressor shell assembly 122 will be described. Each of the snap rings 138 may be installed into one of the respective first annular grooves 170. Each O-ring seal 178 may be installed into a respective one of the second annular grooves 176.

The open end 165 of the end caps 134, 136 may be inserted into a corresponding one of the ends, 140, 142 of the body 132. As the end caps 134, 136 are inserted into the ends 140, 142 of the body, each snap ring 138 may contact one of the corresponding chamfered edges 148, which may help urge the snap ring 138 radially inward into a compressed state to fit within the inner surface 146 of the body 132. As the end caps 134, 136 are inserted into the body 132, the O-ring seals 178 may be compressed and form a seal therebetween.

The end caps 134, 136 may be inserted into the ends 140, 142 body 132 until the annular shoulder 164 of each end cap 134, 136 engages a corresponding end 140, 142 of the body 132, and each snap ring 138 aligns with one of the corresponding locking grooves 150. Once aligned, the snap rings 138 may resiliently un-compress radially outward into the corresponding locking groove 150 and restrict or prevent removal of the end caps 134, 136 from the body 132.

It should be understood that both end caps 134, 136 may be assembled onto the body 132 simultaneously or the first end cap 134 may be assembled onto the body 132 before or after the second end cap 136 is assembled onto the body 132. Moreover, the bearing-housing assemblies 124, 126, the motor assembly 128, the compression mechanism 130, and/or any of the other components of the compressor 120 may be installed within the body 132 before one or both of the end caps 134, 136 are assembled onto the body 132.

Disassembly of the compressor shell assembly 122 may be accomplished by inserting a probe-like object (e.g., an elongated, rigid object) into the releasing orifices 156 to radially inwardly compress the snap rings 138 contained therein. In the radially inwardly compressed state, the snap rings 138 may be removed from the locking grooves 150, and the end caps 134, 136 may then be removed from the body 132. It should be understood that although both end caps 134, 136 were described as being disassembled from the body 132 simultaneously, the first end cap 134 may be disassembled from the body 132 before or after the second end cap 136 is disassembled from the body 132.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically illustrated or described. The same may also be varied in many ways. Such variations are not to be regarded as a departure from the disclosure, and all such modifications are intended to be included within the scope of the disclosure.

What is claimed is:

1. A compressor comprising:

a compression mechanism; and a shell assembly housing said compression mechanism and including a body, an end cap, and a snap ring, said end cap at least partially received into said body, said snap ring engaging said body and restricting removal of said end cap from said body, wherein said body includes an inner surface disposed between a first end and a second end of said body and having an annular groove, said snap ring partially received in said groove, wherein said snap ring is resiliently movable between an uncompressed condition in which said snap ring has a first diameter and a compressed condition in which said snap ring has a second diameter that is smaller than said first diameter, wherein said body includes at least one releasing orifice providing access to said annular groove for releasing said snap ring received within said annular groove.

2. The compressor of claim 1, wherein said inner surface of said body includes a ledge, said end cap includes a radially outwardly extending flange, said flange engaging said ledge, and wherein said ledge restricts movement of said end cap relative to said body in a first axial direction and said snap ring restricts movement of said end cap relative to said body in a second opposite axial direction.

3. The compressor of claim 2, wherein said flange includes a groove receiving an O-ring seal therein.

4. The compressor of claim 1, wherein said body includes a chamfered edge disposed at said first end facilitating compression of said snap ring.

5. The compressor of claim 1, wherein said end cap includes an outer wall having a discharge fitting extending therethrough.

6. The compressor of claim 1, wherein said end cap includes an annular side surface having a first groove partially receiving said snap ring therein and a second groove receiving an O-ring seal therein.

7. The compressor of claim 1, wherein said end cap includes a shoulder extending radially outward beyond an inner surface of said body and engaging a first end of said body.

8. A compressor comprising:

a compression mechanism; and a shell assembly including first and second snap rings, a body, and first and second end caps cooperating with said body to enclose said compression mechanism, said body including first and second open ends and an inner surface extending between said first and second ends, said inner surface including a first groove and a second groove, said first end cap at least partially received within said first end and including a first outwardly extending flange engaging said body, said second end cap at least partially received within said second end and including a second outwardly extending flange engaging said body, said first snap ring disposed within said inner surface of said body and engaging said first groove and said first end cap to restrict removal of said first end cap from said body, said second snap ring disposed within said inner surface of said body and engaging said second groove and said second end cap to restrict removal of said second end cap from said body, wherein said body includes at least one orifice extending into each of said first and second grooves facilitating removal of said first and second snap rings from said first and second grooves, respectively.

9. The compressor of claim 8, wherein said first outwardly extending flange engages a first ledge disposed on said inner surface of said body, and said second outwardly extending flange engages a second ledge disposed on said inner surface of said body.

10. The compressor of claim 8, wherein both said first and second outwardly extending flanges include an annular groove receiving an O-ring seal therein.

11. The compressor of claim 8, wherein said first outwardly extending flange engages said first end of said body, said second outwardly extending flange engages said second end of said body.

12. The compressor of claim 8, wherein said body includes a first chamfered edge disposed at said first end facilitating compression of said first snap ring, and a second chamfered edge disposed at said second end facilitating compression of said second snap ring.

13. The compressor of claim 8, wherein both said first and second end caps includes an annular side wall having an annular channel, said first snap ring engaging said annular channel of said first end cap, and said second snap ring engaging said annular channel of said second end cap.

14. The compressor of claim 13, wherein both said annular side walls include a second annular channel each receiving an O-ring seal therein.

15. The compressor shell assembly of claim 8, wherein said first end cap includes an outer wall having a discharge fitting extending therethrough, and said second end cap includes an outer wall having a mounting base.

16. The compressor of claim 8, wherein said first and second snap rings are resiliently movable between an uncompressed condition in which each of said first and second snap rings has a first diameter and a compressed condition in which each of said first and second snap rings has a second diameter that is smaller than said first diameter.

17. A compressor comprising:

a compression mechanism; and a shell assembly housing said compression mechanism and including a body, an end cap, and a snap ring, said end cap at least partially received into said body, said snap ring engaging said body and restricting removal of said end cap from said body, wherein said body includes an inner surface disposed between a first end and a second end of said body and having an annular groove, said snap ring partially received in said groove, wherein said snap ring is resiliently movable between an uncompressed condition in which said snap ring has a first diameter and a compressed condition in which said snap ring has a second diameter that is smaller than said first diameter, wherein said end cap extends axially through said snap ring such that said snap ring extends around said end cap.

18. The compressor of claim 17, wherein said end cap includes a side wall, an end wall disposed at an end of said side wall, and a flange extending radially outward from said side wall, and wherein said snap ring is disposed around an outer periphery of said side wall and between said end wall and said flange.

19. The compressor of claim 17, wherein said body includes an orifice extending through an exterior surface of said body and providing access to said annular groove for releasing said snap ring received within said annular groove.

20. The compressor of claim 17, wherein said end cap includes another annular groove formed in an outer annular surface of said end cap, and wherein said snap ring is partially received within said groove in said end cap and partially received within said groove in said body.

* * * * *